United States Patent [19]

Fujii et al.

[11] Patent Number: 4,592,778

[45] Date of Patent: Jun. 3, 1986

[54] STEELMAKING OF AN EXTREMELY LOW CARBON STEEL IN A CONVERTER

[75] Inventors: Tetsuya Fujii; Nobuo Harada; Shuji Takeuchi; Yoshiei Kato; Hideo Nakamura; Toshikazu Sakuraya; Yasuhiro Habu, all of Chiba, Japan

[73] Assignee: Kawasaki Steel Company, Kobe, Japan

[21] Appl. No.: 745,922

[22] Filed: Jun. 18, 1985

[51] Int. Cl.[4] ..... C21C 7/00

[52] U.S. Cl. ..... 75/59.22; 75/59.23; 75/59.24

[58] Field of Search ..... 75/59.23, 59.24, 59.22

[56] References Cited

U.S. PATENT DOCUMENTS

| | | | |
|---|---|---|---|
| 3,854,932 | 12/1974 | Bishop | 75/49 |
| 3,953,199 | 4/1976 | Michaelis | 75/59.22 |
| 4,160,664 | 7/1979 | Maruhashi | 75/59.22 |
| 4,178,173 | 12/1979 | Gorges | 75/59.22 |
| 4,358,314 | 11/1982 | Normanton | 75/59.22 |
| 4,402,739 | 9/1983 | Nakanishi | 75/59.22 |
| 4,420,334 | 12/1983 | Kato | 75/59.22 |

*Primary Examiner*—Peter D. Rosenberg

*Attorney, Agent, or Firm*—Balogh, Osann, Kramer, Dvorak, Genova & Traub

[57] ABSTRACT

A process for producing an extremely low carbon steel in a top- and bottom-blown converter. The process is characterized in top-blowing a mixed gas of oxygen gas and an inert gas onto a molten steel in the top- and bottom-blown converter. The mixed gas is blown through a top-blowing lance at the final decarburization stage, while a gas (selected from a group consisting of an inert gas, oxygen gas and a mixture of oxygen and an inert gas) is bottom-blown into the molten steel in the converter.

7 Claims, 4 Drawing Figures

STEELMAKING OF AN EXTREMELY LOW CARBON STEEL IN A CONVERTER

BACKGROUND OF THE INVENTION (1) Field of the Invention

The present invention relates to a process for melting an extremely low carbon steel in an oxygen-blowing converter. More specifically, the invention relates to a process for speedily and appropriately melting an extremely low carbon steel containing not more than 100 ppm of carbon through a converter blowing without relying upon a vacuum degassing refining.

(2) Description of the Prior Art

The significance in the production of an extremely low carbon steel with not more than 100 ppm of carbon by only a converter is mentioned below with referring to a steel sheet to be extremely deeply drawn which is frequently used as a steel product for the automobiles.

When the extremely low carbon cold rolled steel sheet for extremely deep drawing is subjected to heat treatment in a continuously annealing equipment, it has been conventionally necessary to adopt a complicated process in which subsequent to heating and quenching, reheating is performed for effecting overaging treatment. However, a sufficient non-aging property is not necessarily assured stably through the overaging treatment.

As regards this point, it has been recently made clear that when an extremely low carbon steel sheet having the content of carbon of, for instance, around 30 ppm is used, sufficient deep drawability and stable non-aging property can be obtained through simply heating and cooling treatment only.

As obvious from the above example, while various excellent characteristics can be obtained depending upon kinds of steels by lowering the content of carbon down to not more than 100 ppm, such an extremely low carbon steel can be first melted by subjecting a molten steel containing not more than 500 ppm of carbon which has ordinarily been refined in a steelmaking furnace such as a converter to a vacuum refining treatment of RH or DH system or the like for a long time of period.

However, when the time period for the vacuum treatment is prolonged, it becomes difficult to assure the temperature of a molten steel which is fit to the succeeding continuous casting step due to the drop in temperature during the treatment. If the converter steel tapping temperature before the vacuum treatment is largely elevated to cope with this problem, the durable life of the refractory material of the converter is shortened, thereby resulting in problems such as increased cost and efficiency drop due to repair.

On the other hand, the top- and bottom-blown converter has been developed to improve the metallurgical characteristics of the top-blown converter, that is, to reduce the oxidation of iron and manganese in a molten steel, and it is its fundamental requirement to mainly increase the force of stirring the molten iron with a bottom-blown gas.

The reason why T.Fe in the slag are reduced in the top- and bottom-blown converter as compared with the top-blown converter and the reason why the oxidation rate of Mn in the molten iron decreases are that the reaction in the molten iron or between the molten iron and the molten slag approaches an equilibrium state due to the increased molten iron-stirring force so that preferential decarburization effectively proceeds.

However, it has been heretofore considered to be economically impractical to effect decarburization down to not less than 100 ppm in the carbon content in the oxygen top-blown converter. This is because when $O_2$ gas is blown into the molten steel having a reduced carbon content from a top-blowing lance, oxidation reaction of the molten iron takes place together with the decarburization reaction so that with the decrease in the carbon content the oxidation reaction of the iron exceeds the decarburization reaction to increase the loss of iron through oxidation and lower the yield of an iron source to a large extent.

Therefore, the limit for the decarburization in the oxygen top-blown converter is generally considered to be 150–250 ppm.

In order that the preferential decarburization required in melting the extremely low carbon steel may advantageously and continuously proceed, the reduction in the CO partial pressure as well as the approaching to the equilibrium through increased stirring force must be done. For proceeding the decarburization reaction under the control of the oxidation reaction, there has been proposed another approach in which an inert gas such as nitrogen or Ar gas is mixed into $O_2$ gas to be fed from the top-blowing lance, that is, the $O_2$ gas is diluted with the inert gas to lower the CO partial pressure. This approach is that the partial pressure of carbon monoxide in the furnace which is considered to be ordinarily at an atmospheric pressure is lowered through dilution to cause the following reaction:

$$C+\tfrac{1}{2}O_2 \rightarrow CO\ (g)$$

preferentially to the oxidation reaction of iron:

$$Fe+\tfrac{1}{2}O_2 \rightarrow FeO$$

thereby attaining the decarburization.

However, according to this process, the attainable limit value is around 120 ppm at the largest, and an extremely low carbon steel containing not more than 100 ppm of carbon cannot be obtained. Further, this method is inevitably accompanied with the loss of iron through oxidation, and consequently the yield of iron is lowered to 90% or less.

Moreover, according to this process, a mixed gas of oxygen and an inert gas is blown only at a flow rate of 1–1.5 $Nm^3$/min per 1 ton of the molten iron by using a horizontal-blowing tuyere or a bottom-blowing tuyere. When the mixed gas is blown at such a flow rate, that of $O_2$ is naturally less than 1–1.5 $Nm^3$/min so that the decarburizing rate is low and such a process is clearly unsuitable for the rapid refining.

In addition, there has been reported a process for melting an extremely low carbon steel containing about 150 ppm of carbon in an oxygen bottom-blown converter such as a Q-BOP. However, since a coolant, lime and so on are bottom-blown besides oxygen in the bottom-blown converter, the installation cost and the refining cost become higher due to the blowing equipment and an attendant equipment for blowing powder without being clogging.

SUMMARY OF THE INVENTION

It is therefore a first object of the present invention to provide a process for melting an extremely low carbon steel by a converter blowing only, which omits the vacuum treating step, and realizes great efficiency improvement and extensive cost reduction through restraining the unit consumption of the refractory material which is accompanied by such a treating step.

It is a second object of the present invention to attain the blowing of an extremely low carbon steel containing not more than 100 ppm of carbon without lowering the yield of the iron source to a large extent.

It is a third object of the present invention to provide a cheap steelmaking process which can be easily carried out by a simple modification that an inert gas blowing opening is provided in a top-blown converter, and can assuredly realize the decarburization down to not more than 100 ppm of carbon content.

It is a fourth object of the present invention to provide a process for producing an extremely low carbon steel which drastically promotes the decarburizing rate through blowing a mixed gas at a large flow rate without interrupting preferential decarburization, thereby performing rapid refining.

According to a first aspect of the invention, there is a process for producing an extremely low carbon steel in a top- and bottom-blown converter, which process comprises top-blowing a mixed gas of oxygen gas and an inert gas through a top-blowing lance at a final decarburization stage during blowing in the converter.

According to a second aspect of the present invention, there is a provision of a process for producing an extremely low carbon steel in a converter, which process comprises top blowing a mixed gas of oxygen gas and an inert gas through a top-blowing lance at a final decarburization stage during blowing in the converter, while the inert gas being blown into a molten bath from the bottom of the converter by using horizontal-blowing tuyeres or bottom-blowing tuyeres.

According to a third aspect of the present invention, there is a provision of a process for melting an extremely low carbon steel in a refining vessel equipped with a concentric double pipe tuyere and an attendant top-blowing lance in which oxygen gas or a mixed gas of oxygen and an inert gas is blown under the bath surfce of a molten iron charged in the refining vessel through the inner pipe of the double pipe tuyere, while a protecting gas for cooling the tuyere being blown through a space beteen the double pipes of the tuyere, which process comprises continuing ordinary top- and bottom-blowing in which oxygen or the mixed gas is blown into the molten iron in the refining vessel through the top-blowing lance and the inner pipe of the double pipe tuyere until the content of carbon in the molten iron reaches 200–5,000 ppm, and subsequently mixing the inert gas into the molten iron through the top-blowing lance to continuously perform preferential decarburization at a low carbon content range until the blowing is terminated.

As compared with the high-alloy steel, the extremely low carbon steel (e.g. for the automobiles), is a mass-product of a far lower price (cost), and of slight improvement on the efficiency and the yield, which greatly effects or influences the price competitive force, not to speak of the omission of the vaccum treating step and the saving of the converter installation cost. Therefore, the accomplishment of the above-mentioned objects according to the present invention in melting the extremely low carbon steel brings about an extremely great usefulness.

Further, according to the present invention, an extremely low carbon steel can be extremely speedily and advantageously melted by using a refining vessel such as a so-called top- and bottom-blown converter with a decarburization rate being improved, while causing no excess loss of iron through oxidation, that is, in an economical manner.

More specifically, while a CO partial pressure at a reaction zone between the gas and the molten steel, that is, an ignition point, can be lowered by blowing a mixed gas in which a large amount of an inert gas, that is, $N_2$, Ar or the like is mixed with oxygen through a top-blowing lance which ordinarily blows not less than a half of the total amount of oxygen gas to continue the preferential decarburization in a low carbon content range, the molten steel can continuously be strongly stirred by the bottom-blown gas.

These and other objects, features and advantages of the invention will be well appreciated upon reading of the invention when taken in conjunction with the attached drawings with understanding that some modifications, variations and changes of the same could be easily done by the skilled in the art to which the invention pertains without departing from the spirit of the invention or the scope of claims appended hereto.

BRIEF DESCRIPTION OF THE ATTACHED DRAWINGS

For a better understanding of the invention, reference is made of the attached drawings, wherein:

FIGS. 1 and 2 are graphs illustrating the relation between the mixed ratio of an inert gas or the flow rate of the bottom-blown inert gas and the attained content of carbon, respectively; and FIGS. 3(*a* and *b*) is a schematic view illustrating an example of the process for melting an extremely low carbon steel according to the present invention in which the practicing stage is separated at [C]=200–5,000 ppm.

DETAILED DESCRIPTION OF THE INVENTION

Figure 1:
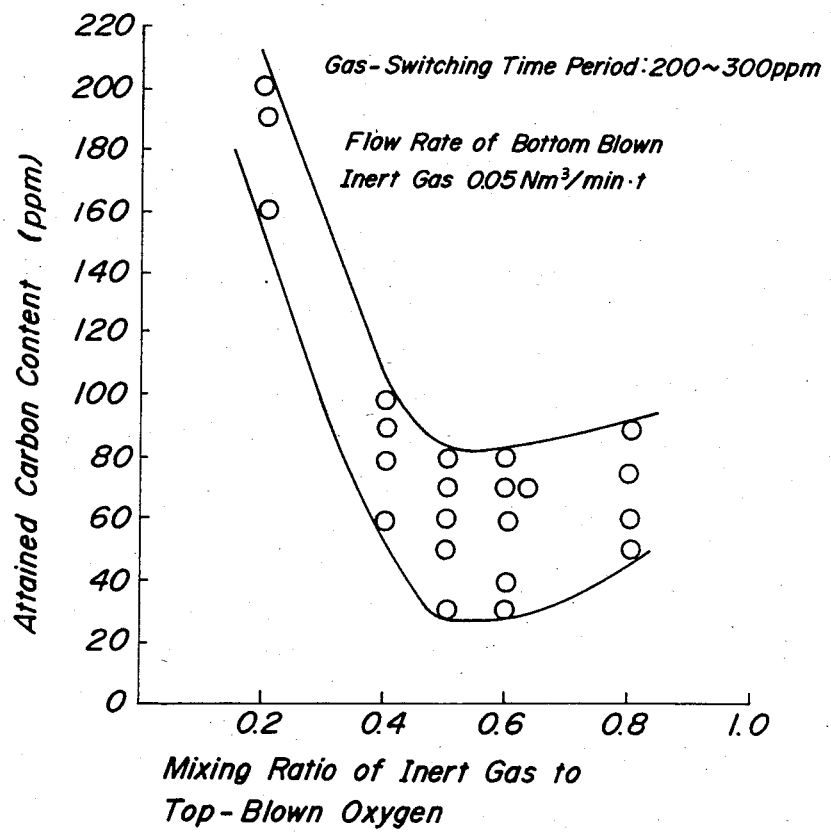

Upon having made various experiments and studies with respect to the resolution of the problem that it is generally difficult to lower the carbon content down to not less than 100 ppm in the conventional converter, the present inventors have accomplished the present invention as described below. The invention will be explained more in detail with reference to some of these experiments.

Namely, experiments were conducted by using a 5 ton test converter to make clear the reason why according to the conventional process the loss of iron through oxidation increases and the lower limit for the attainable content of carbon is restricted to around 120 ppm. Consequently, it has first been confirmed that there is caused conspicuous maldistribution with respect to the temperature and the components in the molten steel during the blowing when the carbon content is in a range of a low carbon content of not more than 300 ppm.

This was thought to be because the decarburization reaction is inactivated in the low carbon content range and an amount of CO gas generated from a bath accordingly decreases to lower the effect of stirring the molten steel with CO gas. Particularly, it has been made clear that the conspicuous maldistribution of the carbon content is attributable to the fact that the carbon content becomes extremely low at an ignition point region where $O_2$ gas is brought into contact with the bath despite that the carbon content is high at a region other than the ignition point region, and the decarburization reaction is interrupted and only the oxidation of iron proceeds so that only an extremely low carbon steel containing about 120 ppm of carbon at the lowest can be obtained.

Noting the above-mentioned experimental facts, when the inert gas such as argon and nitrogen was in trial blown through a tuyere from the bottom of the top-blown converter in combination with the blowing of a mixed gas of oxygen and the inert gas onto the steel bath from a top-blowing lance, an extremely low carbon molten steel containing not more than 100 ppm of carbon can be melted without largely lowering the yield of the iron source.

According to the present invention, the final decarburizing stage, that is, a time period at which while the pure oxygen gas from the top-blowing lance is switched to the mixed gas of oxygen and the inert gas, the inert gas is blown from the bottom of the converter, is preferably at a time when the content of carbon is lowered to about 300 ppm~about 150 ppm. If this switching is done more earlier in a high content range of more than 300 ppm, it takes a long time to effect the decarburization down to not more than 100 ppm of the carbon content and a large amount of the inert gas is used during the decarburization, although the production of oxide of iron can be restrained. Thus, such an earlier switching is ineconomical. As a matter of course, the mixed gas may be used as the bottom-blown gas.

On the other hand, if the switching is done at a carbon content of less than 150 ppm, although the time period during which the succeeding decarburization is carried out with the mixed gas is shortened, the loss of iron through oxidation until the switching to the mixed gas becomes larger to lower the yield. The timing for the above switching can be judged with no practical trouble depending upon the presumption calculation of, for instance, accumulated blown amount of oxygen, or the lapse of time, or empirical judgement factors such as flame or the pressure at the top of the converter, besides the actual measurement by a sensor.

With respect to the mixing ratio of the inert gas to the oxygen gas, $Q_i/(Q_{o2}+Q_i)$ in which $Q_i$ and $Q_{o2}$ are the flow rates of inert gas and oxygen respectively, although the loss of iron through oxidation is restrained with the increase in the mixing ratio, the time for decarburization through the blowing with the mixed gas becomes longer and the use amount of the inert gas becomes larger. Thus, too much mixing ratio is uneconomical. To the contrary, if the mixing ratio is too small, the loss of iron through oxidation is increased, the yield of iron is lowered, and the decarburization reaction is interrupted so that it takes a longer time until the content of carbon reaches an extremely low range of not more than 100 ppm. From this point of view, there is an optimum value for the mixing ratio, and it was confirmed from the experimental results that the lower limit for the mixing ratio is not less than 0.3, and preferably not less than 0.5, while the upper limit is preferably around 0.9 principally from the economical standpoint of view.

With respect to the flow rate of the bottom-blown gas, the larger the flow rate of the bottom-blown gas the more is the production of the oxide of iron restrained and the lower the attainable carbon content. It was confirmed that the gas flow rate is required to be not less than 0.03 $Nm^3$/min, preferably not less than 0.05 $Nm^3$/min, per 1 ton of the molten steel for obtaining the molten steel containing not more than 100 ppm of carbon.

Experimental Operation

A 5 ton top- and bottom-blown converter equipped with 3 to 6 stainless steel pipe tuyeres having a diameter of 3 mm~5 mm at the bottom thereof was prepared, and about 5 tons of desulfurized molten iron having an ordinary composition (C=4.0~4.3%, Si=0.2~0.4%, Mn=0.25~0.35%, P=0.10~0.12%, S=0.010~0.025%; temperature of hot metal 1,230°~1,270° C.) was charged into the converter. Standard blowing conditions were that the flow rate of the bottom-blown inert gas was 0.03 $Nm^3$/min per 1 ton of the molten steel, the flow rate of the top-blown oxygen gas was 3 $Nm^3$/min per 1 ton of the molten steel, and at the final decarburizing stage when the carbon content was fallen in 200~300 ppm about 20 minutes after the blowing start, a mixed gas of oxygen gas and Ar gas was mixed into the molten steel while the mixing ratio of the Ar gas to the top-blown oxygen gas being in a range of 0.2~0.8 and the total flow rate of the oxygen gas and the Ar gas being kept constant at 3 $Nm^3$/min per 1 ton, and the flow rate of the bottom-blown gas was simultaneously increased to 0.03~0.6 $Nm^3$/min per 1 ton of the molten steel, and then blowing was effected for 5~10 minutes. Such an experimental blowing was carried out with respect to 53 charges.

The relation to the conditions under which the mixed gas was blown for 5~10 minutes was examined with regard to these experiments.

In FIG. 1 was shown as an example of the experimental results the relation between the mixing ratio of the inert gas to the top-blown oxygen and the attained carbon content. When the mixing ratio of the inert gas is not less than 0.4, the carbon content of not more than 100 ppm is attainable. Particularly, stable decarburization is possible at the mixing ratio of not less than 0.5.

Figure 2:
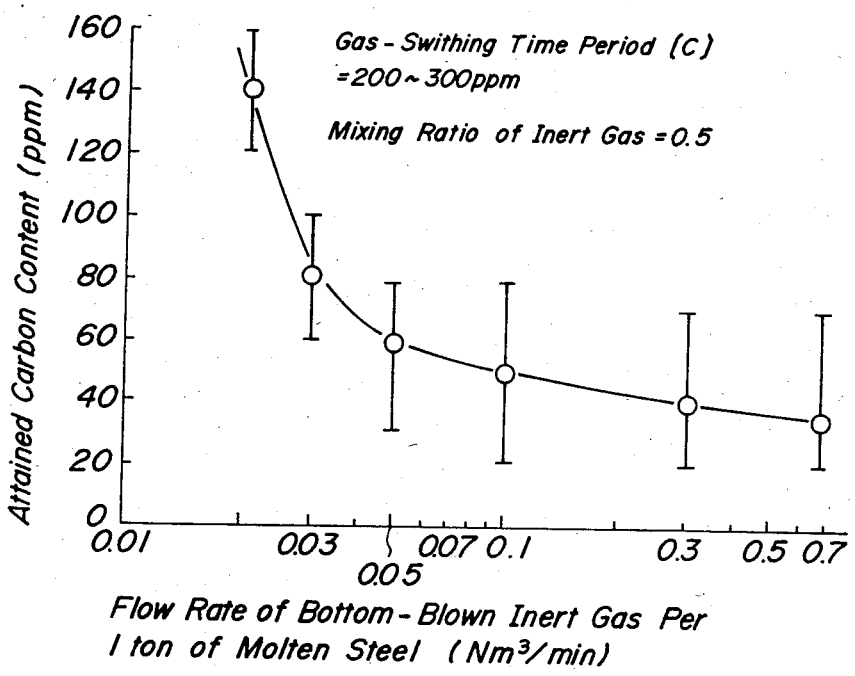

Next, the relation between the flow rate of the inert gas from the bottom-blown tuyeres and the attained carbon content is shown in FIG. 2. From this figure, it is seen that the flow rate of the bottom-blown inert gas is required to be not less than 0.03 $Nm^3$/min per 1 ton of the molten steel for stably obtaining an extremely low carbon steel of not more than 100 ppm of the carbon content.

Working Operation

Based on the above fundamental experimental results, working operation was experimentally carried out in a 150 ton converter to melt an extremely low carbon steel by using a hot metal having substantially the same composition as mentioned above. The experimental conditions are as follows:

Flow rate of the top-blown $O_2$ gas: 430 $Nm^3$/min.

Flow rate of the bottom-blown inert gas (per 1 ton molten steel):

- 0.03 $Nm^3$/min at a time during which only oxygen was blown.
- 0.06 $Nm^3$/min~0.2 $Nm^3$/min at a time during which the mixed gas was blown.

Mixing ratio of the inert gas (Ar) at a time during which the mixed gas was blown: 0.4~0.8 (total flow rate of oxygen gas and the inert gas was kept constant at 430 $Nm^3$/min).

Timing at which pure oxygen was switched to the mixed gas: [C]=160~300 ppm.

Time period during which the mixed gas was blown: 4~10 minutes.

Experiments were carried out under the above-mentioned conditions with respect to totally seventeen charges. Comparative experiments were also conducted with respect to 9 charges under the conditions that the flow rates, the mixing ratio and the switching timing were the same as given above except that while no inert gas was bottom blown, the gas was top blown only.

In the above blowing, the average attained carbon content was 63 ppm fallen in the scope of the present invention with the standard deviation being 28 ppm, and the average yield of iron source was 92.2%. On the other hand, in comparative examples, the average carbon content was 146 ppm with the standard deviation being 42 ppm, and the average yield of the iron source was 88.1%.

As compared with comparative examples, it can be said that the present invention is a more excellent process in that the average value and the deviation of the attained carbon content are decreased without increasing the loss of iron through oxidation.

Figures 3A, 3B:
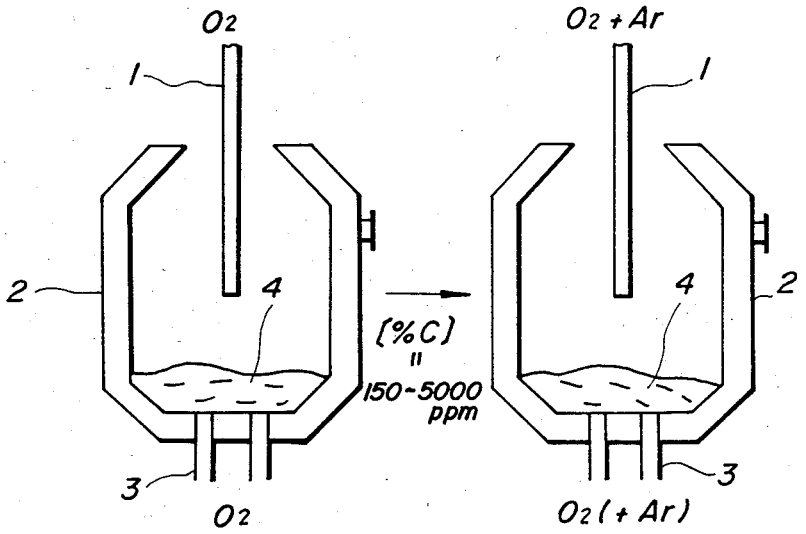

Further, the second aspect of the present invention in which oxygen or the mixed gas of oxygen and the inert gas is bottom-blown will be explained below with reference to FIGS. 3(*a* and *b*) in which reference numerals 1, 2, 3 and 4 are a top-blowing lance, a converter, a tuyere, and a molten steel, respectively.

The decarburizing step is done by an ordinary blowing process in which oxygen is top blown until [C] reaches 150~5,000 ppm, and when the carbon content reaches a range of 150~5,000 ppm, the mixed gas is used instead of the pure oxygen. In the ordinary top- and bottom-blown converter, the time when the decarburization efficiency of oxygen drops from 100% is at the time of the carbon content being around 5,000 ppm. Thus, when the pure oxygen is switched to the mixed gas after the carbon content reaches around 5,000 ppm, the preferential decarburization is continued.

Further, if the dephosphorizing reaction and the reduction in the blowing time period are taken into consideration, when the carbon content is lowered to around 200 ppm and then the pure oxygen is switched to the mixed gas, the dephosphorization reaction is more advantageously effected and extremely low carbon steel can be produced more speedily.

According to the present invention, the mixing ratio of the mixed gas may be varied with the proceeding of the preferential decarburization in a low carbon content range.

The ratio of the inert gas to the total amount of the top-blown gas is preferably 20~85%.

EXAMPLES

A 5 ton converter with a top-blowing lance of Lavel type nozzle was used. The nozzles had an inclined angle of 10° and a throat diameter of 9.5 mm, and four holes were provided. The height of the lance was constant at about 500 mm as measured from the bath surface. As the bottom-blown tuyeres were used four double pipe tuyeres with an inner diameter of an inner pipe of 10 mm and a space of 0.8 mm between the inner and outer pipes. While $O_2$ gas or a mixed gas of $O_2$ gas and an inert gas was blown from the inner pipe, the inert gas was blown as a protective gas for cooling the tuyeres from the space between the inner and outer pipes. As the inert gas, Ar was used in these examples.

The amount of the charged hot metal was about 5 ton, and the temperature thereof was 1,290°~1,310° C. The composition was C=4.3~4.5%, Si=0.3~0.5%, Mn=0.4~0.6%, P=0.11~0.12% and S=0.004~0.005%.

Examples and comparative examples are shown in Table 1.

TABLE 1

| | | Component and temperature just before switching to mixed gas blowing | | | Top-blown conditions | | | Bottom-blown conditions | | | $O_2$/Ar with respect to the sum of top- and bottom-blown amounts | Blowing time period (min) | Components and temperature when steelmaking is finished | | |
|---|---|---|---|---|---|---|---|---|---|---|---|---|---|---|---|
| | | C (%) | T·Fe in slag (%) | Temperature (°C.) | $O_2$ ($Nm^3$/min) | Ar ($Nm^3$/min) | $O_2$/Ar | $O_2$ ($Nm^3$/min) | Ar ($Nm^3$/min) | $O_2$/Ar | | | C (%) | T·Fe in slag (%) | Temperature (°C.) |
| Example | a | 0.02 | 18.3 | 1,650 | 2.5 | 15 | 1/6 | 5.0 | 0 | — | 1/2 | 3.5 | 0.006 | 21.2 | 1,640 |
| | b | 0.48 | 13.7 | 1,660 | 3.3→ 1.7 | 1.7→ 3.3 | 2/1→ 1/2 | 3.3→ 1.7 | 1.7→ 3.3 | 2/1→ 1/2 | 2/1→1/2 | 8.8 | 0.004 | 20.7 | 1,680 |
| | c | 0.50 | 14.9 | 1,650 | 3.3 | 1.7 | 2/1 | 1.7 | 3.3 | 1/2 | 1/1 | 8.5 | 0.005 | 22.1 | 1,690 |
| | d | 0.02 | 19.8 | 1,660 | 5.0 | 5.0 | 1/1 | 3.0 | 3.0 | 1/1 | 1/1 | 3.7 | 0.006 | 22.8 | 1,660 |
| | e | 0.03 | 17.1 | 1,650 | 2.5 | 5.0 | 1/2 | 2.5 | 5.0 | 1/2 | 1/2 | 5.8 | 0.005 | 20.4 | 1,640 |
| | f | 0.03 | 17.4 | 1,640 | 5.0 | 10.0 | 1/2 | 2.5 | 5.0 | 1/2 | 1/2 | 3.4 | 0.006 | 21.3 | 1,640 |
| Comparative Example | a | 0.01 | 24.7 | 1,660 | 2.5 | 5.0 | 1/2 | 2.5 | 5.0 | 1/2 | 1/2 | 6.4 | 0.006 | 27.8 | 1,660 |
| | b | 0.03 | 16.1 | 1,650 | — | — | — | 2.5 | 5.0 | 1/2 | 1/2 | 13.0 | 0.005 | 20.9 | 1,620 |
| | c | 0.02 | 18.4 | 1,650 | 5.0 | — | — | — | 10.0 | 0 | 1/2 | 6.0 | 0.015 | 26.4 | 1,700 |
| | d | 0.46 | 13.8 | 1,660 | — | — | — | 2.5 | 5.0 | 1/2 | 1/2 | 30.0 | 0.008 | 22.1 | 1,650 |

Before the components of the molten steel reached the values shown in the column "Components and temperature just before switching to mixed gas blowing" of Table 1, pure $O_2$ gas was blown for the top blowing and the bottom blowing with respect to examples as well as comparative examples.

As in the case of comparative example a, even when the mixed gas is blown starting from a lower carbon content range, C=0.01%, as compared with Example e, only T.Fe are increased in the slag. When the bottom-blowing is singly employed as in the case of Comparative Examples b and d, the blowing time period is prolonged and temperature drop is large. In the oxygen top-blown+Ar bottom-blown process as in Comparative Example c, the decarburizing efficiency is low, so that the carbon content is not lowered under 100 ppm.

Example f shows that the blowing time period can be remarkably shortened by twice increasing the amounts of $O_2$ and Ar in the top-blown mixed gas in Example e. Such a shortening of the blowing time period may be realized as in Example a in which a large amount of Ar reaching about 86% of the top-blown mixed gas is mixed, and bottom blowing is done with an increased amount of $O_2$ alone.

Further, as in Example b, the blowing may be done while the diluting percentage of the top-blown gas as well as the bottom-blown mixed gas is increased. Alternatively, the blowing may be performed while the diluting percentage is kept constant as in Examples c and d.

The gist of the present invention lies in that pure oxygen gas is blown through the top-blowing lance and the inner pipe of the double pipe tuyere in a range of the carbon content in the molten iron being over 0.50% so as to effect high efficient decarburization. However, inside of the scope of the invention is fallen a case in which an inert gas is mixed into oxygen gas in such a slight amount that it may not interrupt the supply of a large amount of oxygen and the maintenance of a high oxygen partial pressure.

As obvious from the above examples, the present invention has various merits, and particularly, is advantageously applied in case that a continuous annealing equipment is newly installed in a rolling yard in an iron and steelmaking factory in which an LD converter is provided but no vacuum degassing equipment is provided. That is, it has been conventionally necessary that an RH type degassing equipment or the like is newly provided together with a continuous annealing equipment for advantageously producing an extremely low carbon steel sheet. However, by adopting the present invention, an RH step can not only be omitted, but also the installation of a new RH equipment is made unnecessary through a simple modification of the converter. The cost of the installation including of course the running cost of the RH equipment can be largely reduced.

Although the specific examples of the invention have been explained in detail together with their advantages, the present invention is not necessarily restricted to the above-mentioned ones. For instance, the invention is advantageously applied to a case in which the finally intended carbon content is as high as 200 ppm over 100 ppm, because the loss of iron through oxidation can be further suppressed as compared with the common converter blowing.

Furthermore, to increase the mixing ratio of the inert gas into oxygen gas with the proceeding of the decarburization is favorable in terms of efficiency, iron source and yield. The inert gas is not limited to argon or nitrogen, and any gas may do as long as it does not practically impart adverse effect upon the molten steel oxidizing power can be controlled through dilution of oxygen gas therewith to the same extent as in the case of the mixing gas of oxygen and argon gas.

According to the present invention, under a simple modification of the equipment in which a simple bottom-blowing tuyere is provided in a conventional top-blown converter, the steelmaking can be realized in the converter, while being accompanied by the reduction in the yield of iron source over an extremely low carbon range, which has not been expected.

What is claimed is:

1. A process for producing an extremely low carbon steel in a top- and bottom-blown converter, which process comprises top-blowing a mixed gas of oxygen gas and an inert gas onto a molten steel in the top- and bottom-blown converter, through a top-blowing lance at a final decarburization stage during blowing in the converter, while a gas is bottom-blown into the molten steel.

2. The process as claimed in claim 1, wherein the gas bottom-blown into the molten steel from the bottom of the converter is one selected from a group consisting of an inert gas, oxygen gas, and a mixture of oxygen gas and the inert gas.

3. The process as claimed in claim 2, wherein the final decarburization stage is after a time at which the carbon content in the molten steel reaches a range of 150~300 ppm.

4. The process as claimed in claim 2, wherein the mixing ratio of the inert gas to oxygen in the mixed gas top-blown onto the molten steel is from 0.3 to about 0.9.

5. The process as claimed in claim 2, wherein the flow rate of the bottom blown gas is not less than 0.03 $Nm^3$/min per 1 ton of the molten steel.

6. The process as claimed in claim 1, wherein oxygen is top and bottom blown until the content of carbon in the molten steel reaches a range of from 150 ppm to 5,000 ppm, and thereafter the mixed gas is top blown at the final decarburization stage.

7. The process as claimed in claim 6, wherein the inert gas is also bottom blown from the bottom of the converter at the final decarburization stage when the carbon content is 150~5,000 ppm.

* * * * *